United States Patent [19]

Simpson

[11] Patent Number: 4,854,400

[45] Date of Patent: Aug. 8, 1989

[54] WELL DRILLING

[75] Inventor: Brian K. Simpson, Bristol, Great Britain

[73] Assignee: DRG (UK) Limited, United Kingdom

[21] Appl. No.: 132,562

[22] Filed: Dec. 14, 1987

[30] Foreign Application Priority Data

Dec. 17, 1986 [GB] United Kingdom ..... 8630096

[51] Int. Cl.[4] ..... E21B 19/14

[52] U.S. Cl. ..... 175/85; 414/22.58

[58] Field of Search ..... 166/85; 175/85, 161, 175/203, 219; 414/22, 745; 211/70.4

[56] References Cited

U.S. PATENT DOCUMENTS

| | | | |
|---|---|---|---|
| 4,486,137 | 12/1984 | Buckner | 414/22 |
| 4,604,724 | 8/1986 | Shaginian et al. | 414/22 X |
| 4,652,195 | 3/1987 | McArthur | 175/85 X |
| 4,715,761 | 12/1987 | Berry et al. | 175/85 X |

*Primary Examiner*—William P. Neuder

*Attorney, Agent, or Firm*—Cushman, Darby & Cushman

[57] ABSTRACT

A drill rig installation has, for handling the elongate tubular well elements, a handling boom provided with grabs to lift the tubulars from the strongbacks and present them at the drilling axis. For this purpose the boom has pivot mountings for movements about a vertical axis and a horizontal axis respectively, and the grabs are displaceable transversely of the boom. A support pad for the tubular elements is transversely displaceable on the boom jointly with the grabs. The installation further comprises a grid-form base providing a fixed platform on which a drilling derrick can be slid to different grid positions to drill a series of bore holes. The base grid also carries the store of tubular elements and trolleys that register the elements with the handling boom, and other ancillary equipment such as slips and torque wrench machines for assembling and dismantling drill strings.

15 Claims, 4 Drawing Sheets

178
176
180

8
150
30
D
104
152
20
24
22
90
142
144
28
26
2

WELL DRILLING

BACKGROUND OF THE INVENTION

This invention relates to drill rigs and to the handling of equipment at drilling sites.

The scale of operations for drilling gas and oil wells requires considerable resources of equipment and time. The present invention is concerned with the provision of apparatus that can promote the efficient use of well drilling plant.

One of the factors limiting efficiency lies in the capabilities of mechanical handling systems that are able to deal effectively with the cumbersome components with which a well is drilled and lined.

In particular, the elongate tubular elements for drilling a well and for lining the well are normally transported and stored in a horizontal position for a number of practical reasons and must then be brought upright to be positioned coaxially with the drill string when they are brought to use.

It is known (U.S. Pat. Nos. 4,403,879, 4,303,270, 4,403,666 and 4,407,629) to provide a pipe boom that swings tubular elements from a horizontal position to a vertical position. While the boom is horizontal, the pipes are placed or are run into gripping jaws of the boom. With the jaws holding and supporting the pipe, the boom is pivoted to an upright position which brings the pipe to the drilling axis. Such handling equipment has only a limited use, however. In most cases it is still necessary to provide handling means that will lift the individual pipe elements and place them in the jaws of the horizontal boom. In U.S. Pat. No. 4,407,629, although it is arranged that each tubular element rolls into the jaws, when a drill string is subsequently being dismantled it is still necessary to have further handling means to lift the individual elements to remove them from the jaws.

The manipulation and utilization of drill rig equipment are also factors in the efficiency of operation of drill rigs. The need for heavy lifting gear, for example, is a considerable drain on resources and such equipment may be kept on site over the period of drilling operations, for example when it is required to drill a number of holes at the same site. Because of the difficulties from disturbing and resetting an installation, once the equipment is on site it may remain until all its work has been completed, even though there may be long periods of waiting time during which the equipment is idle.

One object of the present invention is to provide an improved means for handling tubular well drilling elements when they are to be transferred between a storage location and the drilling axis.

Another object of the invention is to provide an arrangement which facilitates the manipulation of drill rig equipment.

SUMMARY OF THE INVENTION

According to one aspect of the invention, there is provided apparatus for handling elongate tubular elements for drilling a well and/or lining a well comprising means for transferring successive elements from a generally horizontal position to an upright position for the elements to be secured together on the drilling axis, the transfer means comprising an elongate arm that is pivotable between horizontal and vertical positions and also about its own axis, the arm carrying clamping means for holding an individual element, the clamping means being displaceable towards and away from the longitudinal axis of the arm, whereby with the arm in a horizontal position its clamping means can engage the element and, holding the element, the arm can be pivoted to the upright position, turned about its own axis to put the element facing the drilling axis and the clamping means can be extended from the arm to advance the upright element to the drilling axis for connection to a further elongate element on said axis.

Preferably, the transfer arm is rotatable in opposite directions from the position in which the elongate tubular element is brought to face the drilling axis, so that the arm is capable of raising elements lying horizontally on either side of a central vertical plane through the drilling axis and the transfer arm.

In a further aspect, the invention provides a drilling installation comprising a base structure providing one or more drilling stations, a drilling derrick which may be displaceable on the structure between different drilling stations and from which a drill string is operated on a downwardly extending drilling axis, locations on said structure for storing the tubulars (eg. the drill string elements and/or riser elements and/or elongate casing elements) of the well in a horizontal position, means for transporting them in that position to adjacent the derrick, and transfer means for lifting the individual horizontal tubulars from that position to a vertical position and presenting them to the drilling axis to be assembled together on that axis.

By providing a base structure on which the various items of equipment can be placed, it is possible to provide a stable, planar support which can be left fixed and over which much of the equipment can be moved, eg. slid, to different positions without requiring dismantling or the use of heavy lifting equipment. At the same time, if it is foreseen that any of the equipment will not be used for a significant period of time, it is possible to remove it to another site and to return it onto the base structure at a later date without requiring fresh foundations and with a minimum re-alignment work.

Preferably, the base structure is arranged to provide storage space for the horizontal tubulars in at least one row, and means are provided for guiding the transport means along said at least one row to bring the tubulars within reach of the transfer means.

By way of example, a land-based installation according to the invention will be described with reference to the accompanying drawings.

DESCRIPTION OF THE PREFERRED EMBODIMENT

The rig comprises a planar base 2 constructed from steel sections as a grid of cells 4, for example on a three-metre square pitch. Integral with the grid members running in one direction, or fixed to them, are a series of parallel rails 6. Within the grid is shown a group of cells, in this example a rectangular group of 12 cells, alloted as drilling stations for a drilling derrick 8 which is placed over each of the stations in turn to drill bore holes in a known operational pattern from the fixed platform provided by the base 2.

Figure 1:
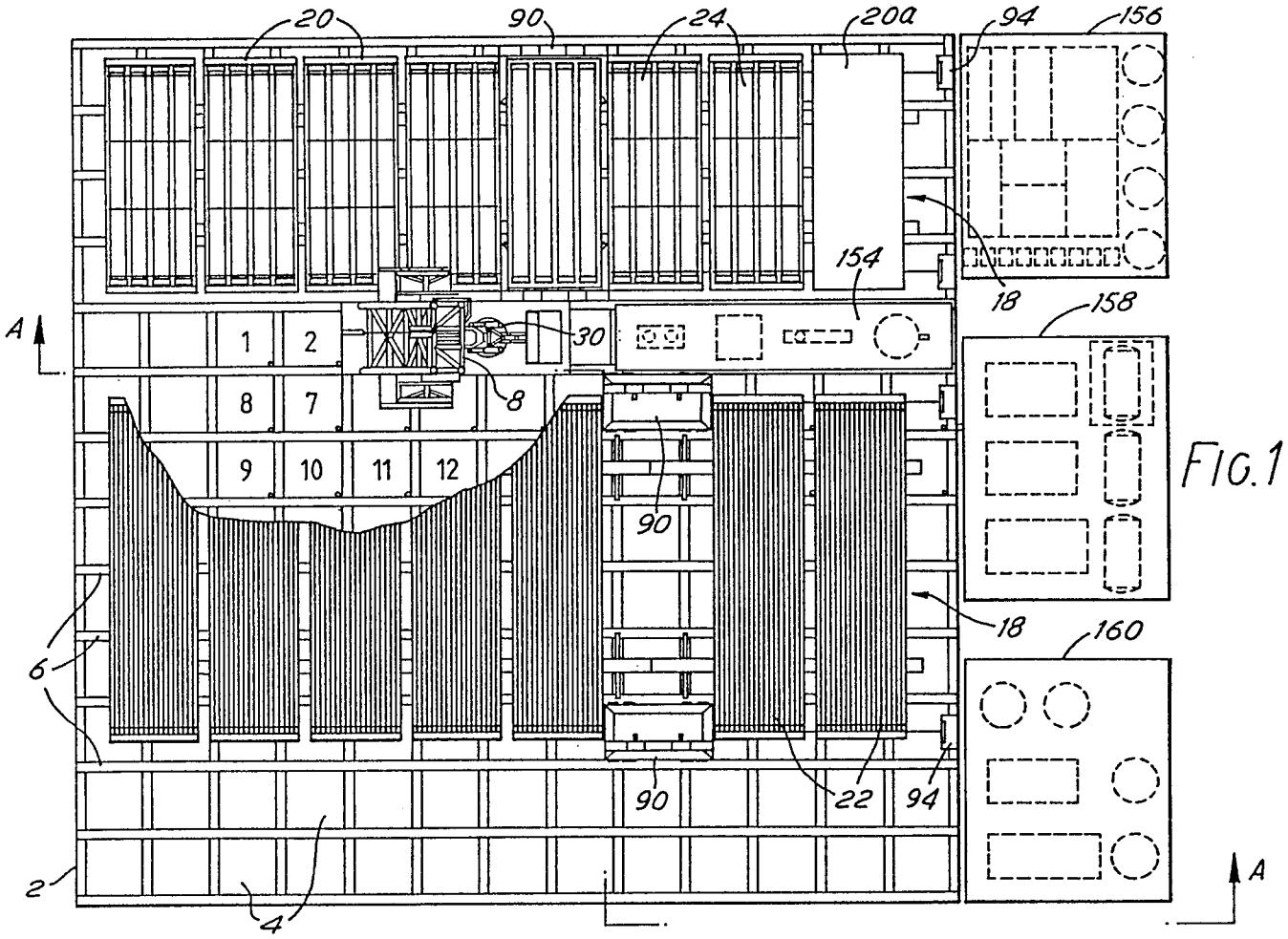
FIG. 1 is a plan view of the installation.

The elongate members employed to drill and line a bore hole, referred to generally as tubulars in well construction, are supplied in transport frames or strongbacks 20 each carrying a number of tubulars and these are held in storage locations 18 on the base on opposite sides of the derrick. For drilling a bore hole the tubulars include drill stands and collars forming the drill string to which the drilling head is attached and casing sections for lining the bore hole. In the case of a floating rig they may also include risers forming an outer tube within which the drill string is operated. To opposite sides of the drilling derrick, raised supports 26 are provided on the base for the tubulars, indicated generally by the reference number 22 and for casing sections 24, respectively, in their strongbacks. The strongbacks 20 are placed in parallel rows, stacked several units high, preferably so that the nearer edge of each row is spaced only a fraction of the grid pitch from the drilling derrick. The axes of the tubulars 22,24 lie at right-angles to these edges. Reference number **20*a* in FIG. 1** simply indicates a space for storing empty strongbacks.

The drilling derrick 8 is secured on a base frame 28 which rests on the base 2. The derrick lattice structure is open at one side facing a handling boom 30 by means of which the individual tubulars are lifted from the strongbacks and presented for assembly on the drilling axis D. The boom is mounted on the base frame 28 through a slewing ring 32 that can be driven by a hydraulic motor 34 to rotate the boom through 90° about an axis **32*a* to either side of the central position in which a pair of grabs 36 projecting from the boom are directed towards the derrick. The boom also has a horizontal pivot joint 38 immediately above the slewing ring. By means of hydraulic cylinders 38*a*** the boom can be swung on that joint from the vertical position shown to a horizontal positon.

The two grabs 36 are mounted on the boom on slides 42. Hydraulic jacks 40 between the slides and the boom can extend the grabs 36 jointly outwards from the boom.

Figure 6:
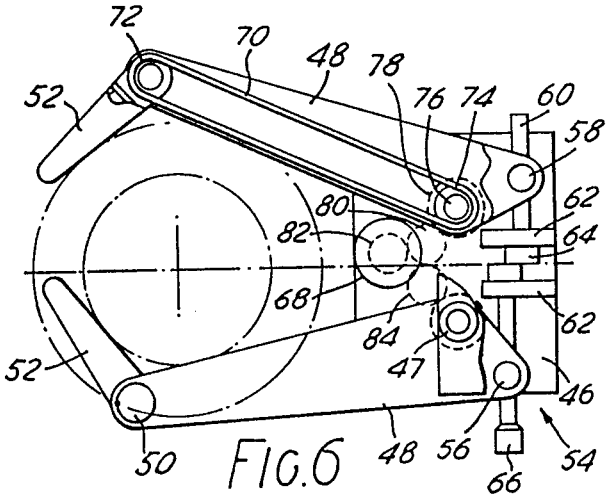
FIGS. 6 and 7 are plan and side views of one of the grabs of the boom.
Figure 7:
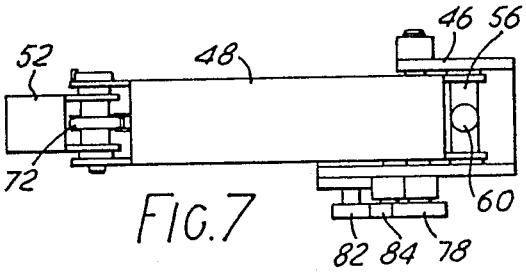
Figure 8:
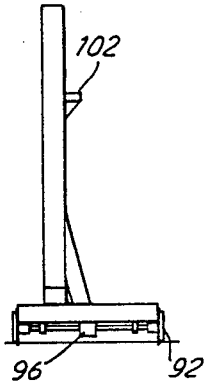
FIGS. 8 and 9 are end and side elevations of one of the transport trolleys of the installation.
Figure 9:
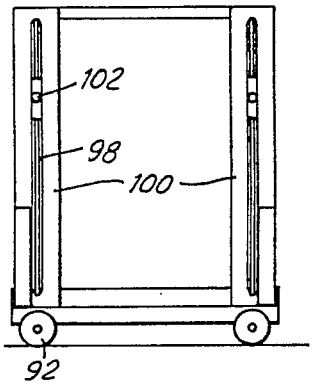

Mounted as a replaceable part of each grab is a gripping jaw 44 comprising a carrier 46 through which the jaw can be bolted to its slide 42. Projecting from the carrier and mounted on it through respective pivots are a pair of grab arms 48. On the outer ends of the arms are pivots 50 for respective clamping fingers 52. The arms 48 can be set to a required angle on their pivots by a turnbuckle device 54 so as to adjust them to a range of tubular diameters. In FIG. 6 the respective arms are shown in opposite end limits of adjustment, but it is to be understood that at any time they will lie at equal and opposite angles to the central plane between them. At the inner end of each arm there is journalled a swivel pin 56 through threaded bores 58 of which a screw 60 of the turnbuckle device extends, engaging the two swivel pins with oppositely handed screw threads. In its length midway between the pins 56, the screw 60 passes through clearance holes in locating plates 62 secured to the carrier and between those plates it has an enlarged portion 64, so that it is located axially by the plates. By means of a head 66 at one end, the screw can be rotated and, because it is axially fixed, the swivel pins 56 move along the screw in opposite directions as it is rotated, pivoting the arms 48 jointly inwards and outwards to adjust them to the spacing required for a given tubular diameter.

To grip the tubular when it is located between the arms, the clamping fingers 52 are swung inwards by a common drive motor 68 on the carrier. Each finger is rotatable on its pivot 50, eg. by a drive chain 70 passing around sprocket wheels 72,74 that are respectively fixed on the finger pivot 50 and on a shaft 76 that also has an input gear wheel 78 fixed to it.

An intermediate gear wheel 80 on the carrier 46 connects a drive pinion 82 on the motor 68 directly to the input gear wheel of one drive chain. A further gear wheel 84 between the intermediate wheel 80 and the input gear wheel of the other drive chain rotates that second input wheel 78 in the opposite sense, so that the fingers 52 open and close together.

The axis of the slewing ring 32 is fixed relative to the drilling derrick 8 so that while the derrick is operating at a particular station the strongbacks 20 containing the tubulars must be moved along each row into the operating range of the boom. For this purpose each of the two rows of stacked strongbacks is provided with a pair of conveyor trolleys 90 on opposite sides of the row, the trolleys having flanged wheels 92 that run on the rails 6 on the top face of the base 2. The trolleys are powered by a pressure hydraulic supply from reels 94 positioned at the end of the base and providing pressure fluid for drive motors 96 of the trolley and for lifting motors (not shown) that rotate screw jacks 98 on opposite end pillars 100 of each trolley to raise and lower lifting lugs 102 that can be engaged with the underside of a chosen strongback to raise it from its stack to an operating level. The stacks are confined to below the operating level so that the trolleys can transport a raised strongback from any chosen position along the row of strongbacks to the boom.

Figure 10:
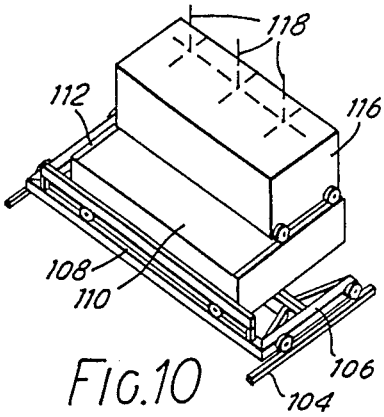
FIG. 10 illustrates the slips machine and torque wrench machine of the installation.
Figure 11:
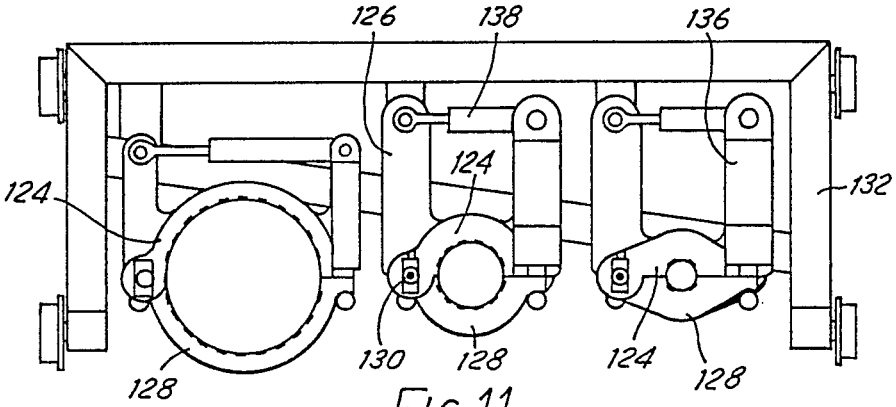
FIGS. 11 and 12 are a plan view and a front elevation illustrating the torque wrench machine in further detail.
Figure 12:
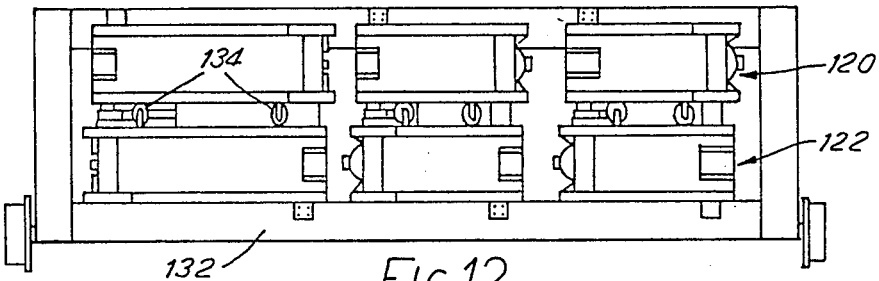

Within the base of the drilling derrick there is a track 104 extending from the drilling axis away from the boom. The track supports a cross-carriage 106 having rails 108 at right-angles to the track and on which a slips machine 110 is mounted. Further rails 112, parallel to the rails 104 on which the cross-carriage rides, are disposed on top of the slips machine and on these is mounted a torque wrench machine 116. The two machines each carry a series, e.g. three, alternative units for different diameters of tubulars as indicated by the axes referenced 118 in FIG. 10, and the slips units may also have replaceable bushings for adapting them more closely to particular tubular diameters. The slips units may themselves be of conventional form and are not individually illustrated. The torque wrench units that can be disposed coaxially with the slips units are shown in more detail in FIGS. 11 and 12.

The three torque wrench units in these figures have similar mechanisms, each comprising upper and lower pairs of jaws 120,122. Each pair of jaws consists of a first jaw 124 integral with a torque arm 126, and a second jaw 128 pivoted on the first jaw by a hydraulic actuator 130 to open and close the jaws. The first jaw of the lower pair is fixed on the machine frame 132 and the upper pair is supported on the lower pair through rollers 134 to be rotatable coaxially thereon. When closed, the jaws of each pair are clamped together by a hydraulic cylinder 136 mounted on the torque arm 126 and gripping the free end of the second jaw. A further hydraulic cylinder 138 connects the torque arms 126 of the upper and lower pairs of jaws and by its displacement the upper pair 120 can be rotated in either direction on the fixed lower pair 122. By coordinated operation of the cylinders 136,138, a torque wrench unit clamped around a drill string at the joint between two drill stands can therefore torque up (i.e. tighten) or torque down (loosen) that joint.

Within the base frame 28 a turntable 142 is mounted on a vertical axis carrying alternative blow-out stack preventers 144 of conventional design. By rotation of the turntable a chosen preventer can be positioned on the drilling axis. Alternatively the stack preventers 144 can be carried on a linearly displaceable carriage (not shown) as will be understood without further illustration.

Drilling is performed by a power swivel 150 suspended from the head of the derrick 8 and raised and lowered by a drilling winch 152 at the base of the derrick. Further description of these units is not required as they can be of entirely conventional form. Other conventional units shown in the drawings are a mud treatment plant 154 on the base adjacent the drilling derrick, and separate modules 156,158,160, the first containing equipment for mud storage, mixing and air surge tanks, the second with mud pumps and air and hydraulic compressor plant, and the third with cement mixing, storing and pumping plant.

The form of the installation permits it to be used economically in a number of ways and is particularly well suited for land-based or fixed platform drilling. As one example, the base 2 can be one of a number permanently placed at chosen drilling sites and the remainder of the equipment can be moved around between these sites as operational requirements dictate. The various units when brought to the base are placed in the correct location in relation to the parallel rails 6 but can then be slid along the rails by conventional skid displacement methods used for moving heavy loads. When required, the operating units can be jacked up sufficiently to skid them across the rails or to put them on wheels or other temporary bearers for such cross movements. The strongbacks 20 are simply laid in their rows on top of the supports 26 with the adjacent edges of the rows suitably positioned in dependence upon the location at which the drilling derrick 8 is to be used.

As drilling proceeds, the trolleys 90 of the drill element strongback stacks are operated to bring each strongback within the range of the boom and then, moving in a series of steps, to bring the axis of each tubular into line with the boom slewing ring axis. Known control devices (not shown), including electronic data processing means, ensure that the trolleys of each pair move corresponding distances to keep them aligned to each other and to bring them to the required positions along the row, and further such control devices can actuate and sequence the other movements of the apparatus described.

When the trolleys have brought a strongback to the handling boom 30, the boom is rotated through 90° in the required direction from its cental position, in which the grabs 36 project radially towards the drilling axis. The boom is now facing the horizontal drill elements, and it is lowered about its pivoted joint 38, with the grabs 36 extended, to grasp the drill element that is registered with the slewing ring axis. The grabs are then retracted to lift the drill element. As the boom is pivoted back to the vertical position, the grabs have only a frictional engagement on the drill element and it is able to slide downwards onto a location pad 170 mounted on the boom to project below the grabs. With the boom now vertical and the grabs retracted, the boom is rotated on its slewing ring so that the tubular faces the drilling derrick 8. The location pad is displaceable perpendicular to the boom axis by hydraulic jacks 172, like the grabs, and the pad and grabs are jointly extended to move into the open side of the derrick and thereby locate the tubular on the drilling axis. There the tubular is attached to the power swivel 150 from which it is suspended when the grabs are released and the grabs and the location pad are jointly retracted. It may be noted here that the use of the location pad as a temporary support for the tubulars limits the power requirements of the grabs and reduces the risk of damage to the tubulars through excessive clamping forces.

After the grabs and the location pad have been retracted clear of the derrick, the power swivel finally lowers the tubular towards the existing drill string where, by manipulation of the appropriate slips and torque wrench units, it can be coupled to the drill string in known manner. While the tubular is being secured to the drill string, the boom returns to pick up a further tubular which has been registered with its slewing axis in the meanwhile.

Figures 2, 13:
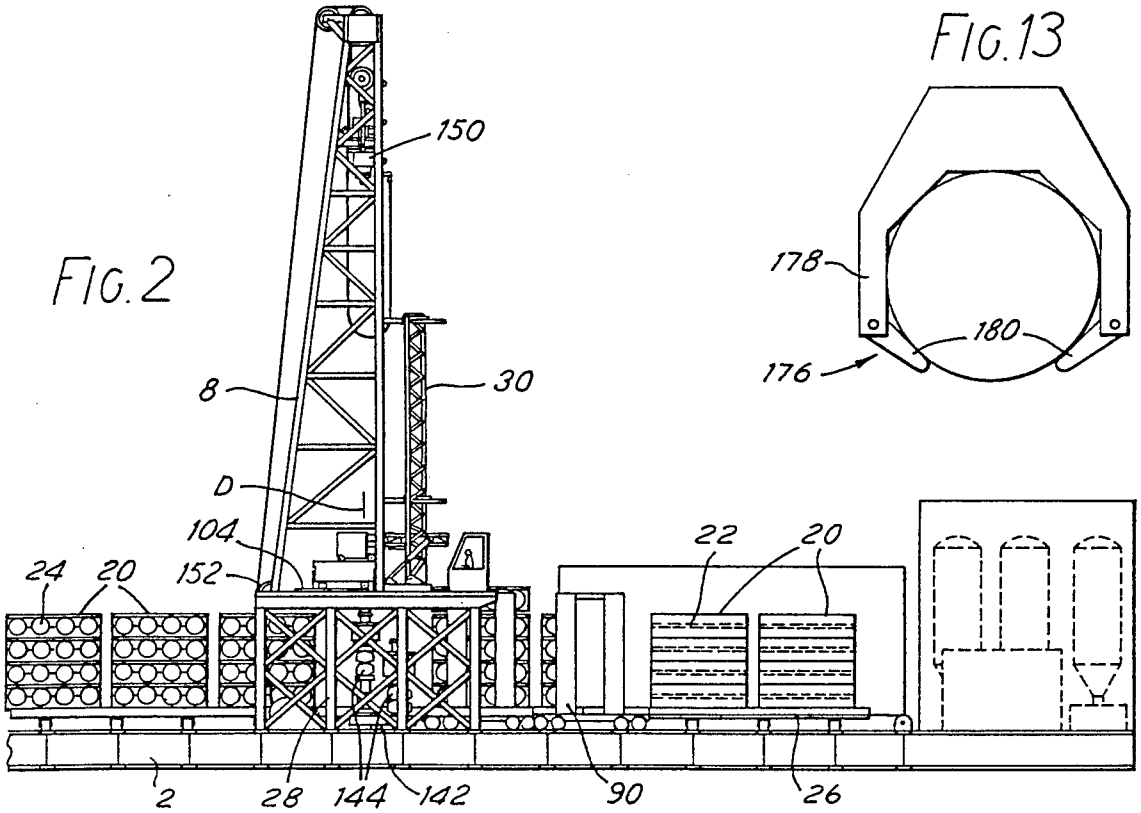
FIG. 2 is a section on the line A—A in FIG. 1.
FIG. 13 shows a grab for a larger diameter tubular.
Figure 3:
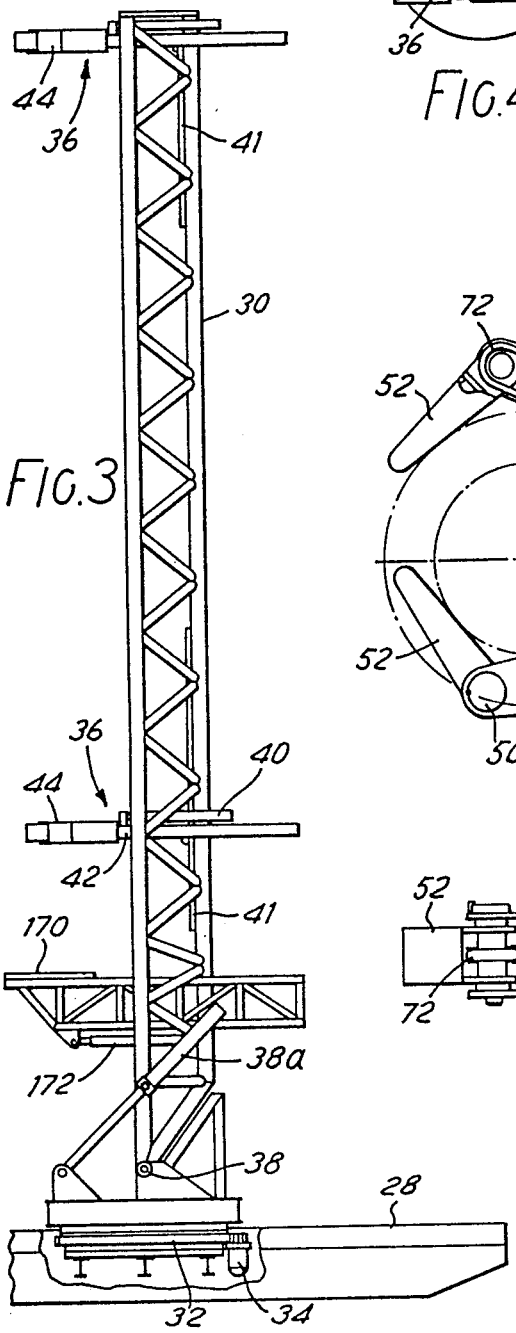
FIGS. 3 and 4 are a side elevation and a top plan view, to a larger scale, of the handling boom of the installation.
Figure 4:
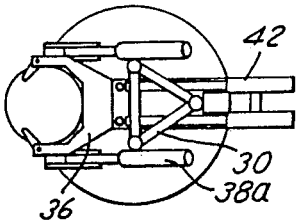
Figure 5:
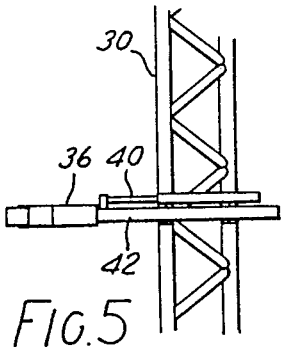
FIG. 5 is a detail illustration showing one of the grabs of the boom in an extended position.

The well casing sections are handled in a similar manner, but as they can be of a considerably greater diameter, alternative grab jaws may be required. FIG. 13 illustrates an alternative configuration of jaws 176, intended in this example for a 30 inch (750 mm) diameter section, having arms 178 which form a rigid, non adjustable unit, but carry clamping fingers 180 operated in the similar manner to the fingers 52 of the jaws 44 already described. The jaws 44,176 are very simply exchanged by mounting them on tubulars, or similar supports, in position in which their carriers can be registered with the securing means on the boom and attached to those means when the boom is swung down onto them about its pivot joint 38.

It will be understood that dismantling of the drill string elements and liners can be carried out by an analagous reverse operation, using the handling boom to take the tubulars as they are detached by the torque wrench machine and place them in their strongbacks which are then stacked where desired in the row.

A feature of the installation described is that all the operations of assembling or removing a tubular can be pre-programmed and performed automatically on a command from the operator. The programming and control means can be provided by apparatus and techniques well known to persons in the art and so not require further particularisation here.

By the use of the apparatus, the deployment of the tubulars can be performed efficiently, simplifying the tasks of their assembly and dismantling and so minimising the time taken for these tasks. The ability to move the equipment between similar, relatively inexpensive support bases at different sites allows a more efficient deployment of the drilling equipment and its ancillary plant, so reducing drilling costs further.

I claim:

1. Apparatus for handling elongate tubular elements that are to be assembled together on a drilling axis for use in a well-forming operation, comprising drilling rig means from which said tubular elements are suspended on a drilling axis, transfer means for transferring successive tubular elements from a generally horizontal position to a generally upright position for the tubular elements to be secured together on the drilling axis, the transfer means comprising an elongate arm, a basal support for said arm, first and second pivot mounting means between said arm and said basal support for movement of the arm on said first pivot mounting means between said generally horizontal and upright positions, and for movement of the arm on said second pivot mounting means about an upwardly extending axis, clamping means carried by said arm for holding an individual tubular element, displacement means between the clamping means and the elongate arm for displacing the clamping means toward and away from a longitudinal axis of the arm, whereby, when the arm is in a horizontal position, its clamping means are extendable downwards to engage the tubular element and, when the arm is in an upright position and rotated to put the tubular element facing the drilling axis, the clamping means are extendable to advance the upright tubular element to the drilling axis for connection to a further tubular element on said axis.

2. Apparatus according to claim 1 the transfer arm is rotatable on said second pivot mounting in opposite directions from the position in which the elongate tubular element is brought to face the drilling axis, whereby the arm can raise tubular elements lying horizontally on either side of a central vertical plane through the drilling axis and said axis of rotation of the second pivot mounting means.

3. Apparatus according to claim 1 wherein a bottom support is carried by the transfer arm for supporting at least a greater part of the weight of an elongate tubular element held by the clamping means in the upright position.

4. Apparatus according to claim 3 having displacement means between the bottom support and the arm for displacing the bottom support towards and away from the longitudinal axis of the arm in conjunction with said displacement of the clamping means.

5. Apparatus according to claim 1 wherein the clamping means comprise a plurality of jaws, each jaw comprising a mounting, a pair of grab arms projecting from said mounting to define a space between them in which a said elongate tubular element is received, said arm having free ends distal from said mounting, clamping fingers on said free ends of said arms, and pivot connections between said fingers and said ends of the arms whereby the fingers are pivotable to clamp the tubular element against the grab arms.

6. Apparatus according to claim 5 wherein the clamping means further comprise adjustment means for moving the grab arms towards and away from each other to accommodate different diameter elongate tubular elements, said adjustment means engaging both said arms whereby said arms are moved by said means simultaneously in directions opposite to each other.

7. A drilling installation comprising a drilling derrick from which a drill string is operated on a downwardly extended drilling axis, a base structure on which said derrick is supported, said base structure providing a plurality of alternative operating locations for said derrick between which the derrick is displaceable, at least one storage location on said base structure for elongate tubular elements for the well being drilled and in which the tubular elements are held in a generally horizontal position, and transfer means supported on said base structure for lifting and pivoting the tubular elements from the horizontal position in said storage location to bring said tubular elements to a position whereby the tubular elements are essentially in alignment with said downward extending drilling axis to be coupled together on said drilling axis.

8. An installation according to claim 7 wherein the base structure is in the form of a grid having a series of cells and said cells of said grid provide alternative drilling stations over each of which the derrick can be located in turn.

9. An installation according to claim 7 wherein the base structure provides said storage location for the elongate tubular elements in at least one row, and the transfer means comprise lifting means for presenting said elements to the drilling axis and transport means movable along said at least one row for transporting the tubular elements to bring them within reach of said lifting means.

10. An installation according to claim 9 wherein said transport means comprise a pair of trolleys, upwardly displaceable support members on said trolleys for said elongate tubular elements and guidance and displacement means for moving said pair of trolleys along the length of said at least one row for said trolleys to lift said tubular elements by respectively supporting opposite ends of each tubular element or group of tubular elements.

11. An installation according to claim 9 wherein the base structure is in the form of a grid forming a series of cells with parallel boundaries and rails are provided on the grid running along said parallel boundaries of said cells for the guidance of the transport means.

12. An installation according to claim 7 further including a torque wrench comprising upper and lower pairs of jaws, means for clamping said upper and lower pairs of jaws around a drill string and means for angularly displacing the clamped jaws oppositely, the clamped jaws having alternative and opposite directions of relative angular displacement for tightening or loosening a joint of the drill string.

13. An installation according to claim 7 further comprising a torque wrench machine, a plurality of different size torque wrenches on said machine, first guide means on which said torque wrench machine is mounted for displacement in a first direction towards and away from the drilling axis to locate the machine operatively at said axis, and second guide means which said torque wrench machine is mounted for displacement in a second direction tranverse to said first direction of a chosen one of said torque wrenches for use on the drilling axis.

14. A drilling installation comprising a drilling derrick from which a drill string is operated on a downwardly extended drilling axis, a base structure on which said derrick is supported, said base structure providing a plurality of alternative operating locations for said derrick between which the derrick is displaceable, at least one row of storage locations on the base structure for elongate tubular elements for the well being drilled, said tubular elements being held in a generally horizontal position in said storage locations, transfer means supported on the base structure for transferring the tubular elements between said storage locations and the drilling axis, said transfer means comprising lifting means for presenting the tubular elements substantially coaxially to the drilling axis and transport means movable along said at least one row of storage locations for bring the tubular elements from location in said row to a location within reach of said lifting means.

15. A drilling installation comprising a drilling derrick from which a drill string is operated on a downwardly extended drilling axis, a base structure on which said derrick is supported, said base structure providing a plurality of alternative operating locations for said derrick between which the derrick is displaceable, at least one storage location on said base structure for elongate tubular elements for the well being drilled and in which the tubular elements are held in a generally horizontal position, transfer means supported on said base structure for lifting the tubular elements from said storage location and for presenting the tubular elements to be coupled together on said drilling axis, a torque wrench machine having a plurality of different size torque wrenches for the coupling and decoupling of the tubular elements on said axis, first guide means on which said torque wrench machine is mounted for displacement in a first direction towards and away from the drilling axis to locate the machine operatively at said axis, and second guide means on which said torque wrench machine is mounted for displacement in a second direction transverse to said first direction for selection of a chosen one of said torque wrenches for use on the drilling axis.

* * * * *